US006786814B2

(12) United States Patent
Chen

(10) Patent No.: US 6,786,814 B2
(45) Date of Patent: Sep. 7, 2004

(54) COIN COUNTING DEVICE

(76) Inventor: Chih-Nan Chen, No. 132, Tinghsin Rd., Sanmin Dist., Kaohsiung (TW)

( * ) Notice: Subject to any disclaimer, the term of this patent is extended or adjusted under 35 U.S.C. 154(b) by 132 days.

(21) Appl. No.: 10/307,040

(22) Filed: Nov. 27, 2002

(65) Prior Publication Data

US 2004/0102149 A1 May 27, 2004

(51) Int. Cl.[7] ..... G07D 1/00
(52) U.S. Cl. ..... 453/33
(58) Field of Search ..... 453/33, 18, 29, 453/30, 49, 57, 63

(56) References Cited

U.S. PATENT DOCUMENTS 5,098,339 A * 3/1992 Dabrowski ..... 453/30
5,254,032 A * 10/1993 Abe ..... 453/56
5,616,074 A * 4/1997 Chen ..... 453/30
5,688,166 A * 11/1997 Chen ..... 453/57
6,261,170 B1 * 7/2001 Bell et al. ..... 453/57
6,685,552 B2 * 2/2004 Nomura ..... 453/33

* cited by examiner

*Primary Examiner*—Donald P. Walsh
*Assistant Examiner*—Mark J. Beauchaine
(74) *Attorney, Agent, or Firm*—Dellett & Walters

(57) ABSTRACT

A coin counting device has a base, a driving device, a rotating disk, a bearing ring, a coin container and a coin discharging device. The rotating disk is rotatably mounted on the base and is securely connected to a shaft of the driving device. The bearing ring is detachably attached to the rotating disk and has multiple rollers rotatably attached to the bearing ring. The coin container is securely attached to the base to contain coins. The coin discharging device is attached to the base and has a counter to count the amount of the coins. Accordingly, the bearing ring can be detached from the rotating disk when one of the rollers on the bearing ring is damaged. The structure of the rotating disk is simplified, and the cost for repair the counting device is lowered.

7 Claims, 4 Drawing Sheets

COIN COUNTING DEVICE

BACKGROUND OF THE INVENTION

1. Field of the Invention

The present invention relates to a coin counting device, and more particularly to a coin counting device having a simplified and durable structure.

2. Description of Related Art

A coin counting device is mounted on a gaming machine to discharge coins to a player when the player wins a game. A conventional coin counting device in accordance with the prior art comprises a base, a rotating disk, a coin container and a coin discharging device. A driving device with a shaft is mounted on the base. The rotating disk is securely connected to the shaft of the driving device so as to be rotatably attached to the base. The rotating disk has multiple coin holes defined around the rotating disk in a circle. The coin container is attached to the base and has a coin inlet aligning with at least one of the coin holes in the rotating disk. The coin counting device is attached to the base and has a discharging channel and a counting sensor.

When the driving device is switched on, the rotating disk will rotate relative to the base. The coins contained in the coin container will enter and be received in the coin holes in the rotating disk, and the coins will rotate with the rotating disk. When a coin is led to correspond to the discharging channel of the coin discharging device by the rotating disk, the coin will be pushed into the discharging channel and be sent to a game winner. The counting sensor will count the amount of the coins passing through the discharging channel to turn off the driving device when a desired of amount of coins is sent out from the counting device.

To make the rotating disk freely rotate relative to the base, multiple rollers are mounted on the rotating disk and abut the base. However, the rollers have a heavy load due to the weights of the coins received in the coin holes in the rotating disk. The rollers and the base are easily damaged after a period of using with the heavy load provided by the coins, thus the conventional coin counting device is not durable. Furthermore, noise and unstable rotation of rotating disk easily occur due to the damage of the rollers. To prevent noise and unstable rotation of the rotating disk, the damaged roller must be replaced with a new one. However, because the rollers of the conventional counting device are attached to the rotating disk, the whole rotating disk with the rollers must be replaced with a new one. It is wasteful to replace an undamaged rotating disk. In addition, the structure of the rotating disk for the roller rotatable attached thereto is complex, and the cost for manufacturing the rotating disk is high.

To overcome the shortcomings, the present invention tends to provide a coin counting device to mitigate or obviate the aforementioned problems.

SUMMARY OF THE INVENTION

The main objective of the invention is to provide a coin counting device that has a simplified and durable structure and involves a low cost for replacing a damaged element. The coin counting device has a base, a driving device, a rotating disk, a bearing ring, a coin container and a coin discharging device. The driving device is mounted in the base and has a rotatable shaft. The rotating disk is rotatably mounted on the base and is securely connected to the shaft of the driving device. The rotating disk has multiple coin holes defined through the rotating disk and arranged in a circle around the rotating disk. The bearing ring is detachably attached to the rotating disk and has multiple rollers rotatably attached to the bearing ring. The coin container is securely attached to the base and has coin inlet communicating with at least one of the coin holes in the rotating disk. The coin discharging device is attached to the base and has a counter to count the amount of the coins. In such an arrangement, the bearing ring can be detached from the rotating disk when one of the rollers on the bearing ring is damaged. To replace the rotating disk is not necessary, and the cost for repairing the counting device is lowered.

Other objects, advantages and novel features of the invention will become more apparent from the following detailed description when taken in conjunction with the accompanying drawings.

DETAILED DESCRIPTION OF PREFERRED EMBODIMENT

Figure 1:
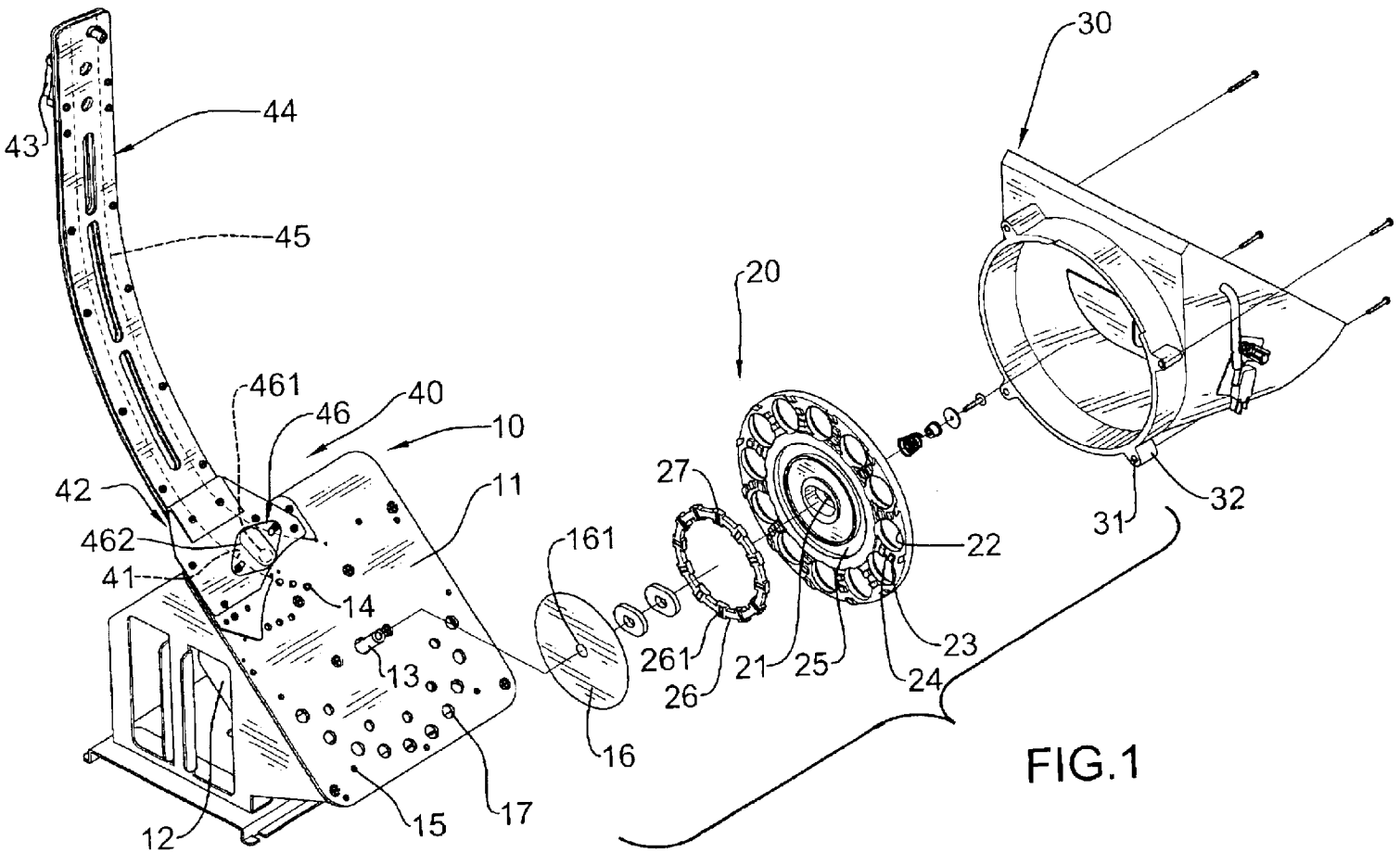
FIG. 1 is an exploded perspective view of a coin counting device in accordance with the present invention.
Figure 2:
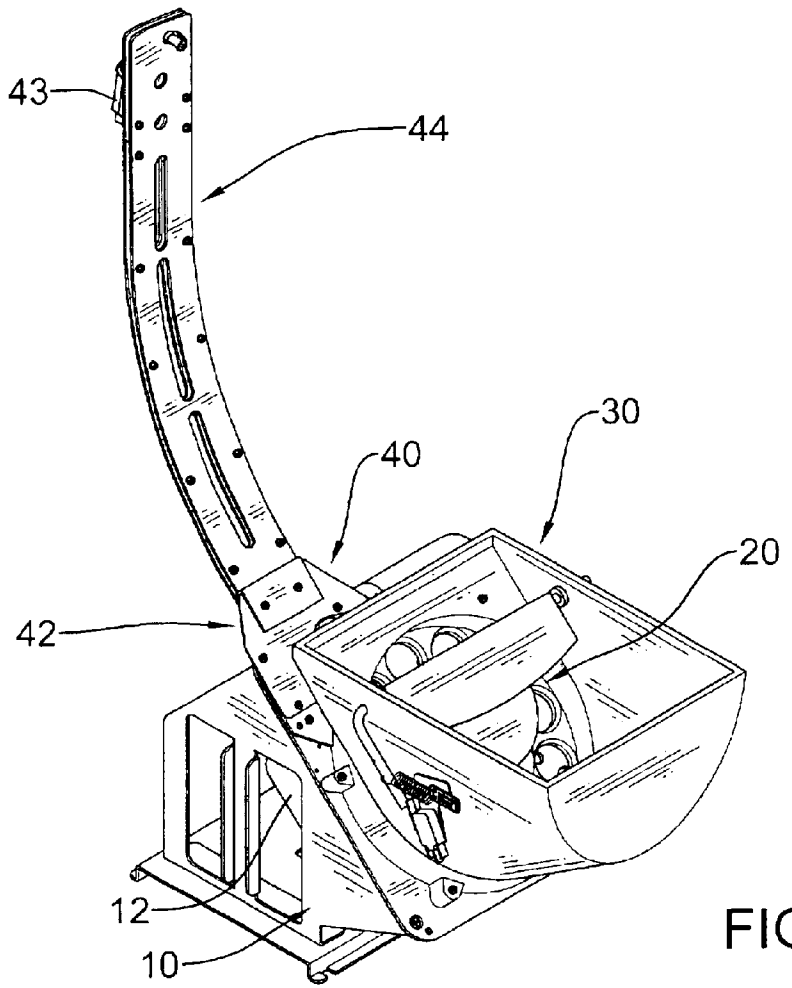
FIG. 2 is a perspective view of the coin counting device in FIG. 1.

With reference to FIGS. 1 and 2, a coin counting device in accordance with the present invention comprises a base (10), a driving device (12), a rotating disk (20), a bearing ring (26), a coin container (30) and a coin discharging device (40). The base (10) has an inclined surface (11) and a stub (14) extending upward from the inclined surface (11). Multiple vents (17) are defined through the inclined surface (11), such that the heat generated during the operation of the coin counting device can be dissipated from the vents (17). Multiple threaded holes (15) are defined in the inclined surface (11).

The driving device (12) is mounted in the base (10) and has a rotatable shaft (13) extending out from the inclined surface (11) of the base (10). In practice, the driving device (12) is a motor.

The rotating disk (20) is securely connected to the shaft (13) of the driving device (12) so as to be rotatably mounted on the inclined surface (11) of the base (10). A noncircular central hole (21) is defined in the center of the rotating disk (20) for the shaft (13) of the driving device (12) penetrating through the central hole (21). After screwing a bolt (not numbered), which penetrates through a gasket, to the free end of the shaft (13), the rotating disk (20) is securely attached to and has a capability of rotating with the shaft (13) when the driving device (12) is turned on. The rotating disk (20) has a first side facing the inclined surface (11). Multiple coin holes (22) are defined through the rotating disk (20) and are arranged in a circle around the central hole (21). The rotating disk (20) is slightly separate from the inclined surface (11), such that a space is defined between the inclined surface (11) and the rotating disk (20) for receiving the coins entering into the coin holes. Two separate protrusions (23) are formed on the first side of the rotating disk (20) and between adjacent coin holes (22) to define a gap (24) between the protrusions (23). The stub (14)

on the inclined surface (11) of the base (10) corresponds to the gaps (24) in the rotating disk (20) and passes through the gaps (24) when the rotating disk (20) rotates relative to the base (10). An annular recess (25) is defined in the first side of the rotating disk (20).

A bearing ring (26) is detachably attached to the annular recess (25) in the first side of the rotating disk (20). Multiple cavities (261) are defined in the bearing ring (26) at a side facing the inclined surface (11) of the base (10), and a roller (27) is rotatably received in each respective cavity (261) of the bearing ring (26). In practice, a gasket disk (16) with a central hole (161) is mounted between the inclined surface (11) and the bearing ring (26) and abuts with the rollers (27) on the bearing ring (26).

The coin container (30) is securely attached to the inclined surface (11) to contain coins. Multiple ears (32), each with a through hole (31), are formed on the coin container (30) and correspond to each respective threaded hole (15) in the inclined surface (11). A screw (not numbered) penetrating through the through hole (31) in each respective ear (32) on the coin container (30) is screwed into the corresponding threaded hole (15) in the inclined surface (11), whereby the coin container (30) is securely attached to the base (10).

A coin inlet (not numbered) is defined through the coin container (30) and communicates with at least one of the coin holes (22) in the rotating disk (20). Accordingly, coins will enter and be received in the space defined between the inclined surface (11) and the rotating disk (20) and corresponding to the coin holes (22) through the coin inlet and the coin holes (22).

The coin discharging device (40) is attached to the base (10) and corresponds to the stub (14) on the inclined surface (11). The coin discharging device (40) comprises a body and a counter (43). In a first embodiment, the body of the coin discharging device (40) has a connecting plate (42) and a guide track (44). The connecting plate (42) is attached to the inclined surface (11) of the base (10). The connecting plate (42) has a coin outlet (41) facing the stub (14) on the inclined surface (11) and communicating with the space defined between the inclined surface (11) and the rotating disk (20). A check device (46) is mounted on the inclined surface (11) of the base (10) and is received in the coin outlet (41) of the connecting plate (42) to keep the coin from moving back to the space between the inclined surface (11) and the rotating disk (20). A cover (462) is attached to the connecting plate (42) to cover the check device (46). In practice, the check device (46) is a steel ball (461) inclinedly mounted on the inclined surface (11) and received in the coin outlet (41).

The guide track (44) is attached to the connecting plate (42). A discharging channel (45) extends through the guide track (44) and communicates with the coin outlet (41) in the connecting plate (42). The counter (43) is attached to the guide track (44) and extends into the discharging channel (45).

Figure 4:
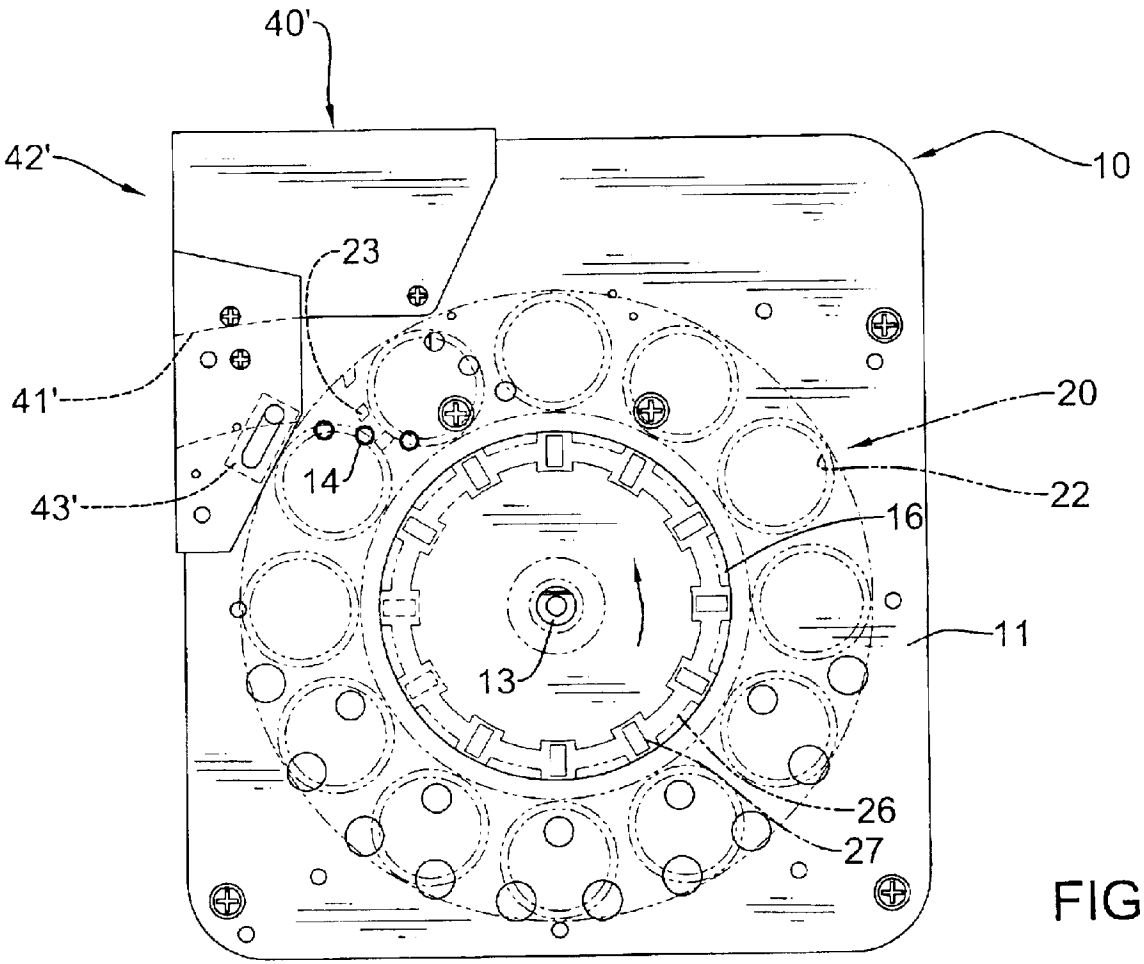
FIG. 4 is a top plan view of a second embodiment of a coin counting device in accordance with the present invention.

With reference to FIG. 4, in another embodiment, the coin discharging device (40') comprises a connecting plate (42') with a coin outlet (41') and a counter (43'). The counter (43') is attached to the connecting plate (42') and extends into the coin outlet (41') to count the amount of coins passing through the coin outlet (41').

Figure 3:
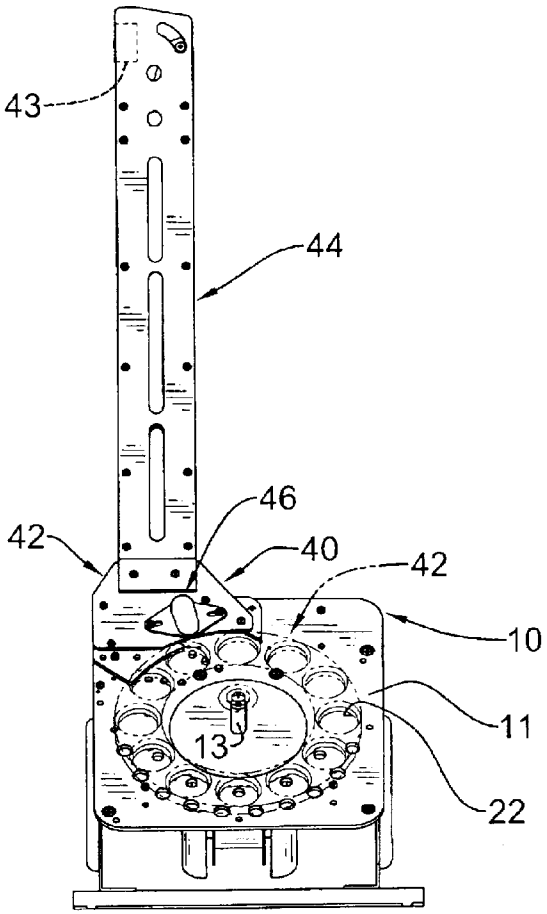
FIG. 3 is a side plan view of the coin counting device in FIG. 1 wherein the coin container is removed.

With reference to FIGS. 1, 3 and 4, when the driving device (12) is turned on, the rotating disk (20) will rotate with the shaft (13) of the driving device (12). The coins received in space between the inclined surface (11) and the rotating disk (20) will be pushed by the protrusions (23) and rotate with the rotating disk (20). When the rotating disk (20) rotates to a position where the stub (14) on the inclined surface (11) enters into the space receiving a coin passes through the gap (24) between the protrusions (23), the stub (14) will push the coin to leave the space and enter the coin outlet (41). The coin will be sent out from the coin outlet (41) directly to a game winner as shown in FIG. 4. In a first embodiment as shown in FIGS. 1 to 3, the coin will enter the discharging channel (45) in the guide track (44) and will be sent out to a game winner by means of being pushed by the following coins. The counter (43) will count the coins passing through the coin outlet (41) or the discharging channel (45). When the coins achieve the amount for the game winner, the driving device (12) is turned off such that no further coins will be sent out from the coin counting device.

In such a coin counting device, because the rollers (27) are mounted on the bearing ring (26) which is detachably attached to the annular recess (25) in the rotating disk (20), to define recesses for receiving the rollers (27) in the rotating disk (20) is not necessary. The structure of the rotating disk is simplified, and the cost for manufacturing the coin counting device is lowered. In addition, when any roller (27) is damaged due to the heavy load provided by the weights of the coins, it is only needed to replace a new bearing ring. To replace a new rotating disk (20) is unnecessary when rollers (27) have to be replaced, such that the waste in changing undamaged element is avoided. Furthermore, because there is a gasket disk (16) mounted between the inclined surface (11) and the rollers (27), the contact of the inclined surface (11) with the rollers (27) is prevented. This can keep the inclined surface (11) from being damaged due to the heavy load provided by the weight of the coins. The coin counting device is durable, and the useful life of the coin counting device is prolonged.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A coin counting device comprising:

a base with an inclined surface and having a stub extending upward from the inclined surface;

a driving device mounted in the base and having a rotatable shaft extending out from the inclined surface of the base;

a rotating disk rotatably mounted on the inclined surface of the base and securely connected to the shaft of the driving device, the rotating disk having a first side facing the inclined surface and multiple coin holes defined through the rotating disk and arranged in a circle around the rotating disk, wherein the rotating disk has two separate protrusions formed on the first side of the rotating disk and between adjacent coin holes to define a gap between the protrusions for the stub on the inclined surface passing through the gap;

a bearing ring detachably attached to the first side of the rotating disk and having a bottom and multiple rollers rotatably attached to the bottom of bearing ring;

a coin container securely attached to the inclined surface and having coin inlet communicating with at least one of the coin holes in the rotating disk; and a coin discharging device attached to the base and corresponding to the stub on the inclined surface, the coin discharging device having a body with a coin outlet corresponding to the stub on the inclined surface and a counter attached to the body to count an amount of coins passing through the coin outlet.

2. The coin counting device as claimed in claim 1, wherein the body of the coin discharging device comprises:

a connecting plate attached to the inclined surface of the base, wherein the coin outlet is defined in the connecting plate; and a guide track attached to the connecting plate and having a discharging channel extending through the guide track and communicating with the coin outlet in the connecting plate, wherein the counter is attached to the guide track and extends into the discharging channel.

3. The coin counting device as claimed in claim 2 further comprising a check device mounted on the inclined surface of the base and received in the coin outlet of the connecting plate.

4. The coin counting device as claimed in claim 1, wherein the body of the coin discharging device comprises a connecting plate attached to the inclined surface of the base, wherein the coin outlet is defined in the connecting plate; and the counter is attached to the connecting plate and extends into the coin outlet.

5. The coin counting device as claimed in claim 4 further comprising a check device mounted on the inclined surface of the base and received in the coin outlet of the connecting plate.

6. The coin counting device as claimed in claim 1, wherein the rotating disk has an annular recess defined in the first side of the rotating disk to receive the bearing ring.

7. The coin counting device as claimed in claim 1 further comprising a gasket disk attached between the inclined face of the base and the first side of the bearing ring and abutting the rollers on the bearing ring for the rotating disk freely rotating relative to the inclined surface.

* * * * *